US005576597A

United States Patent [19]

Reynolds

[11] Patent Number: 5,576,597

[45] Date of Patent: Nov. 19, 1996

[54] PLASMA DISPLAY HAVING BARRIERS FORMED OF PHOSPHOR

[75] Inventor: Jeffery S. Reynolds, Fishers, India.

[73] Assignee: Hughes Aircraft Company, Los Angeles, Calif.

[21] Appl. No.: 274,514

[22] Filed: Jul. 13, 1994

[51] Int. Cl.[6] ..... H01J 17/49

[52] U.S. Cl. ..... 313/582; 313/584; 313/586; 313/485

[58] Field of Search ..... 313/582, 485, 313/584, 586, 422, 484, 514

[56] References Cited

U.S. PATENT DOCUMENTS

| | | | |
|---|---|---|---|
| 3,589,789 | 6/1971 | Hubert | 313/485 |
| 3,701,916 | 10/1972 | Glaser | 313/585 |
| 4,423,356 | 12/1983 | Sato et al. | 313/582 |
| 4,780,644 | 10/1988 | Sakai et al. | 313/584 |
| 5,086,297 | 2/1992 | Miyake et al. | 313/485 |
| 5,182,489 | 1/1993 | Sano | 313/584 |
| 5,396,149 | 3/1995 | Kwon | 313/586 |

*Primary Examiner*—Sandra L. O'Shea
*Assistant Examiner*—Vip Patel
*Attorney, Agent, or Firm*—Leonard A. Alkov; Wanda K. Denson-Low

[57] ABSTRACT

In a preferred embodiment, a plasma display panel, including: two parallely spaced apart dielectric glass layers; a plurality of gas discharge cells formed between the dielectric glass layers, boundaries of the gas discharge cells being defined by phosphor materials, and the phosphor materials serving as barriers between the gas discharge cells; and apparatus to cause gas discharge in the gas discharge cells.

2 Claims, 2 Drawing Sheets

PLASMA DISPLAY HAVING BARRIERS FORMED OF PHOSPHOR

BACKGROUND OF THE INVENTION

1. Field of the Invention

The present invention relates to plasma display devices generally and, more particularly, but not by way of limitation, to a novel plasma display panel which is very economically manufactured and which has increased luminous efficiency and color purity.

2. Background Art

There is a great deal of interest in plasma display panels because such display devices consume far less space in the direction normal to the plane of the picture as compared to conventional cathode ray tubes. While the use of cathode ray tubes as display devices is quite widespread, they suffer from a number of other defects or undesirable features. Cathode ray tubes have a poor small area contrast ratio due to light scattering and a further phenomenon called "halo." When an electron beam impinges on a phosphor surface, that surface radiates light forwardly toward an observer, but light is also radiated inwardly, reflected and radiated back outwardly to form a bright donut or halo spaced around the central spot. This effectively enlarges the visible spot with consequent loss of perceived detail. Present day plasmas display technologies have somewhat similar problems which reduce resolution.

The basic theory of operation of alternating current plasma displays may be found in a number of sources such as U.S. Pat. Nos. 3,559,190; 3,935,494; and 4,233,623, as well as in an article by T. N. Criscimagna and P. Pleshko titled AC PLASMA DISPLAY found in *Applied Physics*, Vol. 40, published by Springer Verlag in 1980, the disclosures of which patents and article are incorporated by reference hereinto.

Briefly, such display devices have a plurality of gas discharge cells arranged in a generally flat matrix, and first and second sets of spaced apart electrodes with each cell located intermediate one electrode of the first set and one electrode of the second set. The display panel is formed with a first generally flat dielectric plate having the first set of electrodes therein, a second generally flat dielectric having the second set of electrodes therein, and with the two plates sealed together about their common periphery to enclose a gas such as a neon-argon mixture. Light emission is caused either by stimulation of such a visibly luminous gas mixture or by stimulation of phosphors within the cell. Phosphors responsive to ultraviolet radiation created by a discharge in a cell through the enclosed gas are coated on the one of the two plates through which the display is viewed or the selected gas may be one such as a neon-xenon mixture which has significant radiation in the visible spectrum in which case the phosphors may be eliminated.

In such known display devices, a gas discharge in one cell may energize the phosphors associated with one or more adjacent cells, resulting in a larger than desired basic picture element and a resultant loss of color purity. Attempts have been made to eliminate this "cross-talk" between adjacent cells by providing an intermediate layer in the form of a perforated plate having individual holes corresponding to individual cells. This attempt creates problems in evacuating the display device and refilling it with the desired gas and further eliminates the desired phenomenon of "priming" wherein some intercellular photon or charged particle migration reduces the voltage necessary to fire or energize a cell.

Further attempts to isolate cells and eliminate cross-talk while retaining the priming feature and allowing charging of the display device with the proper gas mixture have included a zigzag pattern of passageways between cells (U.S. Pat. No. 3,869,630), an orthogonal array of grooves or troughs (U.S. Pat. No. 3,953,756), and dielectric glass spacing bosses separating the cells (U.S. Pat. No. 4,827,186. None of these is entirely satisfactory and all are relatively expensive to manufacture.

Accordingly, it is a principal object of the present invention to provide a plasma display panel which is economical to manufacture.

It is a further object of the invention to provide such a plasma display panel which provides increased luminous efficiency and color purity.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a plasma display panel, comprising: two parallely spaced apart dielectric glass layers; a plurality of gas discharge cells formed between said dielectric glass layers, boundaries of said gas discharge cells being defined by phosphor materials, and said phosphor materials serving as barriers between said gas discharge cells; and means to cause gas discharge in said gas discharge cells.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
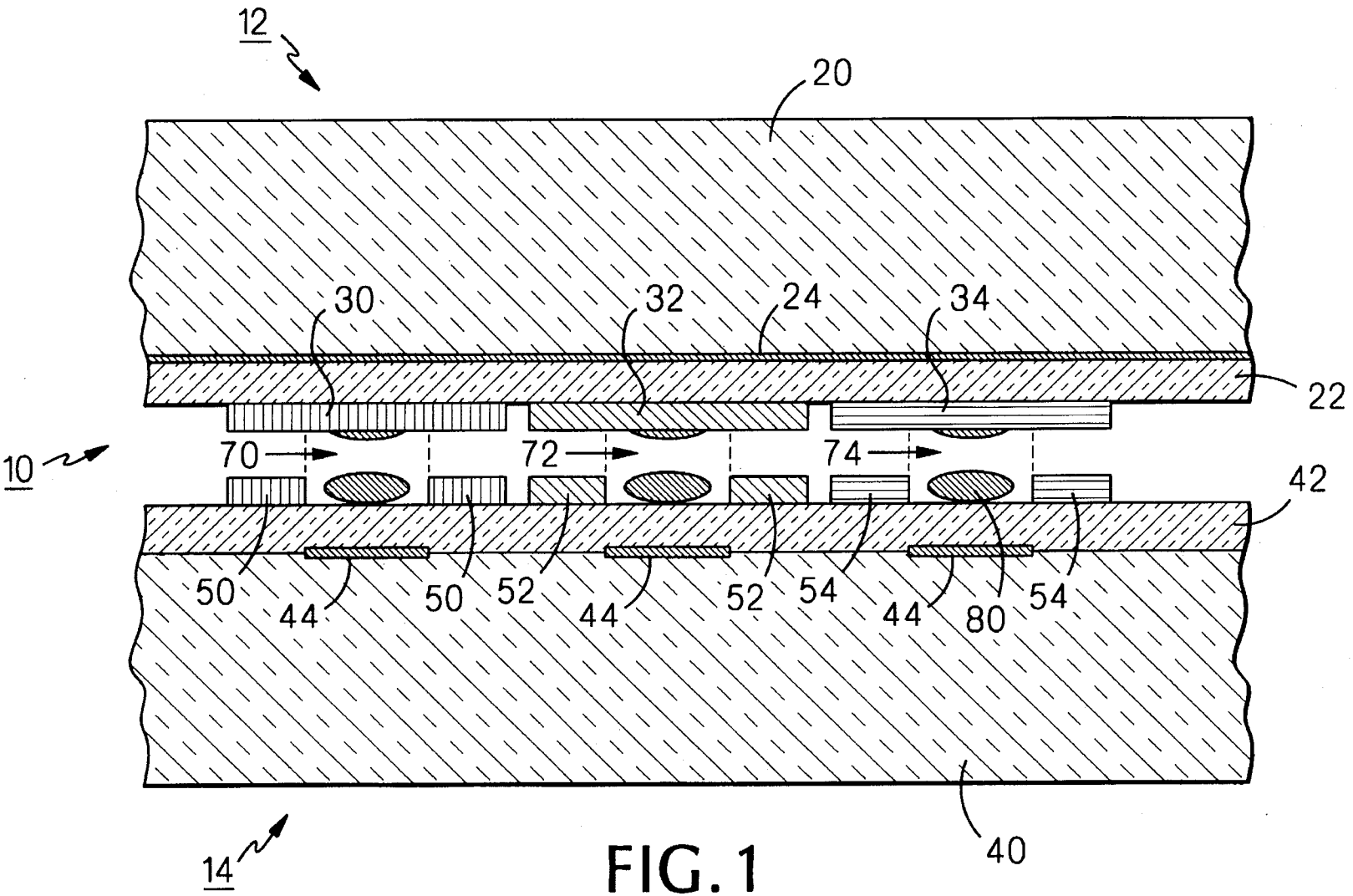
FIG. 1 is an enlarged, schematic, end elevational view, in cross-section, of a plasma display panel constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a plasma display panel, generally indicated by the reference numeral 10, constructed according to the present invention. Panel 10 includes a front panel, generally indicated by the reference numeral 12 and a rear panel, generally indicated by the reference numeral 14.

Figure 2:
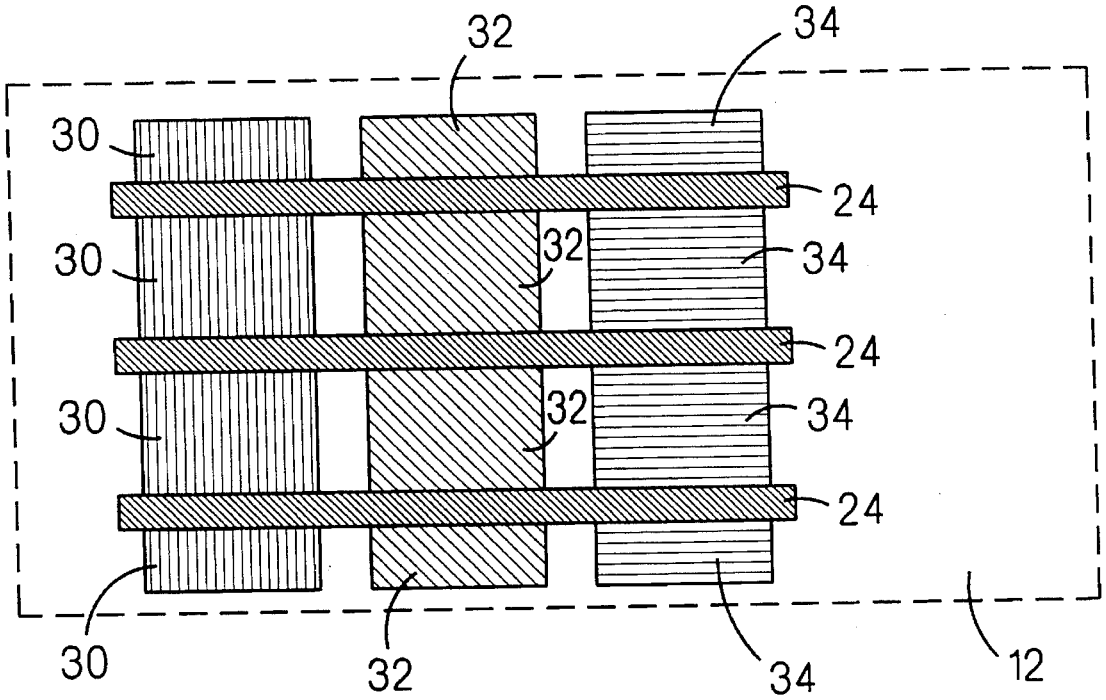
FIG. 2 is an enlarged, bottom plan view, looking up, of the front plate of the plasma display panel of FIG. 1.

With reference also to FIG. 2, front plate 12 includes a substrate glass layer 20 (FIG. 1) having on the lower surface thereof a thin dielectric glass layer 22. Disposed between substrate layer 20 and dielectric layer 22 are a plurality of spaced apart, parallel electrodes 24 (FIG. 2) running right and left on FIG. 2. Disposed on the lower surface of dielectric layer 22 are spaced apart areas of a red phosphor material 30, a green phosphor material 32, and a blue phosphor material 34, the areas being disposed between and adjacent electrodes 24.

Figure 3:
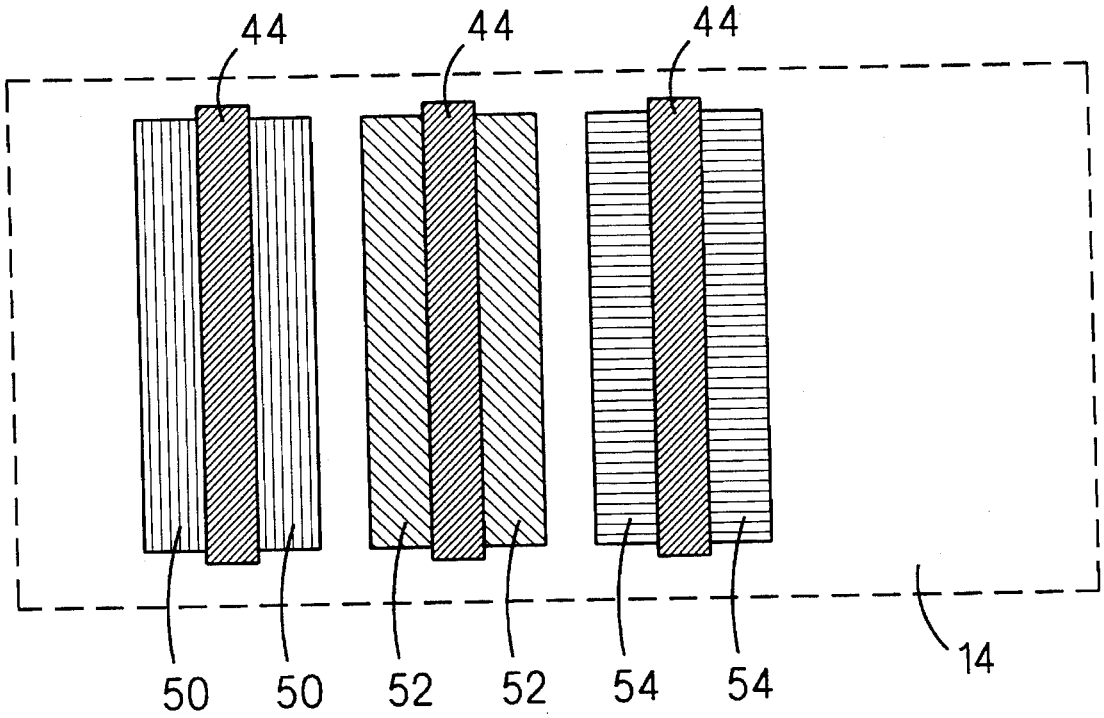
FIG. 3 is an enlarged, top plan view of the back plate of the plasma display panel of FIG. 1.

With reference to FIGS. 1 and 3, back plate 14 includes a substrate glass layer 40 (FIG. 1) having on the upper surface thereof a thin dielectric glass layer 42. Disposed between substrate layer 40 and dielectric layer 42 are a plurality of spaced apart, parallel electrodes 44 (FIG. 3) running up and down on FIG. 3, orthogonal to electrodes 24 (FIG. 2). Disposed on the upper surface of dielectric layer 42 are spaced apart pairs of stripes of a red phosphor material 50, a green phosphor material 52, and a blue phosphor material 54, the stripes being disposed such that each member of a pair is adjacent one of electrodes 44.

Front plate 12 is placed over back plate 14 so that the respective spaces between phosphor materials form a plurality of cells, schematically indicated by the vertical broken lines on FIG. 1. For example, a gas discharge cell 70 is formed between dielectric plates 22 and 42 bounded by those plates and red phosphor materials 30 and 50, the phosphor materials forming barriers around the cell. Likewise, a gas discharge cell 72 is formed between dielectric plates 22 and 42 bounded by those plates and green phosphor materials 32 and 52 and a gas discharge cell 74 is formed between the dielectric plates and blue phosphor materials 34 and 54.

While the use of red, green, and blue phosphors is described as a means of attaining full color displays, this invention also contemplates the use of single (same) color phosphors to attain monochrome displays of any single desired color.

With phosphor on both dielectric layers 22 and 42, maximum conversion of ultraviolet light to visible light can be achieved because phosphor is adjacent to the cold cathode discharge on both ends of the cells, simultaneously increasing luminous efficiency and color purity. Rounded shapes, as at 80, on FIG. 1 indicate the visible glow of light following an ultraviolet light discharge.

The deposition of phosphor materials can be placed through the use of self-registering photolithographic techniques, which is simpler and less costly than forming conventional barriers and which produces higher substrate mechanical tolerances.

It will be understood that the vertical spacing of phosphor elements on FIG. 1 is greatly exaggerated compared to the thicknesses of the other elements and such spacing will normally be on the order of about 0.004–0.005 inch.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A plasma display panel, comprising:

(a) two parallely spaced apart dielectric glass layers;

(b) a plurality of gas discharge cells formed between said dielectric glass layers, boundaries of said gas discharge cells being defined by phosphor materials, and said phosphor materials serving as barriers between said gas discharge cells; and (c) means to cause gas discharge in said gas discharge cells.

2. A plasma display panel, as defined in claim 1, further comprising:

(a) one of said spaced apart dielectric glass layers being disposed on a lower surface of a substrate glass layer of a front plate;

(b) another of said spaced apart dielectric glass layers being disposed on an upper surface of a substrate glass layer of a back plate;

(c) said means to cause gas discharge in said gas discharge cells includes a plurality of parallely spaced apart electrodes disposed between said substrate and dielectric glass layers of said front plate and extending in a first direction, and a plurality of parallely spaced apart electrodes disposed between said substrate and dielectric glass layers of said back plate and extending in a second direction orthogonal to said first direction; and (d) said gas discharge cells being formed by areas of phosphor materials disposed on a lower surface of said dielectric glass layer of said front plate between and adjacent said plurality of electrodes in said front plate, and pairs of stripes of phosphor materials disposed on an upper surface of said dielectric layer of said back plate, the members of each said pairs of stripes adjacent to sides of one of said electrodes in said back plate.

* * * * *